US006636135B1

(12) United States Patent
Vetter

(10) Patent No.: US 6,636,135 B1
(45) Date of Patent: Oct. 21, 2003

(54) REED SWITCH CONTROL FOR A GARBAGE DISPOSAL

(75) Inventor: Chris J. Vetter, Naples, FL (US)

(73) Assignee: Christopher J. Vetter, Naples, FL (US)

( * ) Notice: Subject to any disclaimer, the term of this patent is extended or adjusted under 35 U.S.C. 154(b) by 0 days.

(21) Appl. No.: 10/164,347

(22) Filed: Jun. 7, 2002

(51) Int. Cl.[7] ..... H01H 9/00
(52) U.S. Cl. ..... 335/205; 335/207; 241/46.013
(58) Field of Search ..... 335/205–207, 335/151–153; 241/46.013, 100

(56) References Cited

U.S. PATENT DOCUMENTS 4,319,712 A * 3/1982 Bar ..... 335/206
4,453,148 A * 6/1984 Norakidze et al. ..... 335/207
4,523,083 A * 6/1985 Hamilton ..... 335/205

* cited by examiner

*Primary Examiner*—Lincoln Donovan

(57) ABSTRACT

The invention is directed to a reed switch to control the "on" and "off" operation of a garbage disposal. The reed switch is mounted under a counter top while a magnet is movable on top of the counter top to activate the reed switch. A control device receives signals from the reed switch. Also, the control device includes a rectifier to convert AC current to DC current and also includes a transformer to reduce the high incoming to a low voltage which activates an electromagnetic switch to start the electrical motor of the garbage disposal.

3 Claims, 4 Drawing Sheets

REED SWITCH CONTROL FOR A GARBAGE DISPOSAL

BACKGROUND OF THE INVENTION

The invention is concerned with a reed switch that controls the "on" and "off" operation of a garbage disposal which is disposed under the counter top in the kitchen. The operation of a garbage disposal is well known and does not need any further explanation herein. Suffice it to say that garbage disposals and the switch to operate the same are normally separated from each other at such a distance so that the operator of the garbage disposal cannot be in contact with garbage disposal at all when the disposal needs to be operated. This is a safety feature. On the other hand, when the operator does need to service the disposal, it is quite possible that the person has wet hands because, after all, that person is working on and in the sink under which the garbage disposal is mounted. Wet hands operating an electric switch can cause an electrical hazard. The reed switch of this invention cannot cause any electrical hazards because wet hands cannot come into contact with any electrical installations at all. The reed switch is operated across a considerable air gap which acts as an insulator.

DESCRIPTION OF THE PRIOR ART

Reed switches in their various installations are well known because of their ease of installation. However, they are not known in the installation in kitchens, especially in the operation of a garbage disposal.

U.S. Pat. No. 2,966,561 shows the use of reed switches in combination with the correct setting of bowling pins. Therefore, this teaching is far removed from a use in the kitchen in combination with a garbage disposal.

U.S. Pat. No. 3,463,491 is directed to a bowling pin system in the same environment as the identified paten above.

U.S. Pat. No 3,668,579 illustrates the use of a reed switch in combination with a door alarm system.

U.S. Pat. No. 3,510,069 is directed to a water flow and garbage disposal control system. However, no reed switches are being used in this system but push buttons only. This system controls the water flow system and the use of the garbage disposal unit which under certain circumstances cannot be used or operated.

U.S. Pat. No. 3,445,796 just illustrates a reed switch including signaling means for when a member is being moved.

U.S. Pat. No. 3,760,312 illustrates a reed switch being operated by a rotatable magnet under certain conditions U.S. Pat. No. 3,778,737 illustrates a reed switch being operated by a movable magnet which enters depressions in a supporting surface for activating the switch or for storage when not in use. There is no explanation as to where this switch should be used.

U.S. Pat. No. 3,790,912 illustrates a reed switch being installed on a flashlight with a slideable magnet being operable to establish contact.

U.S. Pat. No. 3,974,469 discloses a magnetic switch assembly including a reed switch biased by moving the magnetic axis of a permanent magnet with respect to the axis of the reed switch. This disclosure in no way impacts on the patentability of the invention disclosed and claimed.

U.S. Pat. No. 3,993,885 discloses a reed switch to assure proper alignment of a cooking vessel of magnetic metal relative to an induction heating coil.

U.S. Pat. No. 5,629,659 shows a magnetic switching device which is utilizing a reed switch to avoid multiple switching and provides greater movement between a magnet an a reed switch. In applicant's disclosed device there is no avoidance of multiple movements.

U.S. Pat. No. 6,016,020 describes a method and an apparatus utilizing a low voltage level actuator and a signal processing device such as a microprocessor to selectively and electrically couple high and low voltage devices.

All of the above noted patents have been cited to illustrate the various uses of reed switches in many different settings, however, none of the prior art teaches the use of reed switches in combination with kitchen appliances.

DETAILED DESCRIPTION OF THE INVENTION

Figure 1:
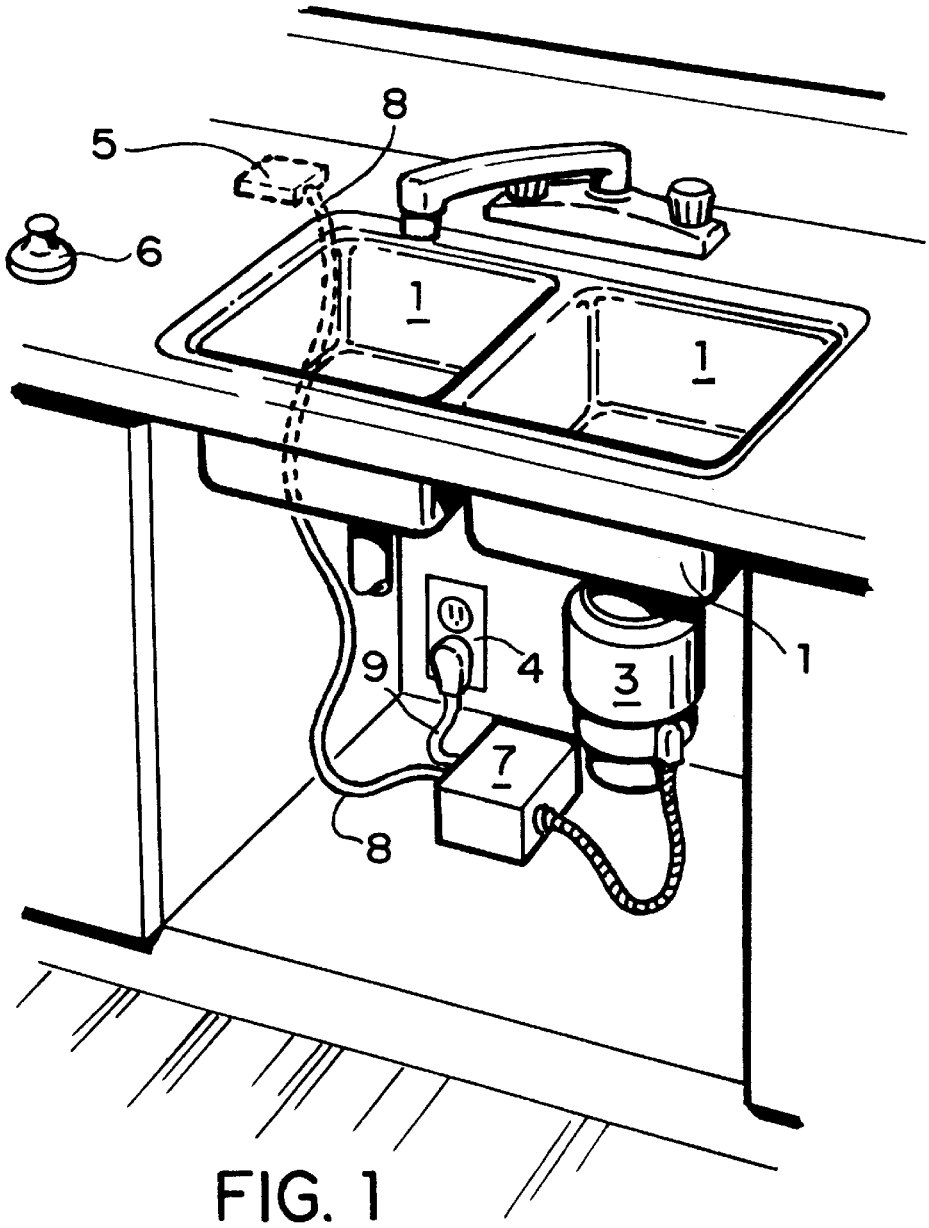
FIG. 1 is a perspective view of a garbage disposal system including the use of reed switch.

FIG. 1 shows an overall view of a garbage disposal system including the switching "on and "off" of the garbage disposal unit. To this end, the sink is shown as 1 which is being installed under the counter top 2. The garbage disposal unit 3 is installed under the sink in a manner which is well known. The electrical power for operating the system is derived from a wall outlet 4. The normally installed switch (not shown) is replaced by a reed switch 5 which can be mounted under the counter top at any desired location. The reed switch 5 is activated by a magnet 6 which can be of any size and shape but it should be strong enough to magnetically excite the reed switch. The electrical functions of the system are operated from the control device 7 which will be explained in subsequent Figures.

Figure 2:
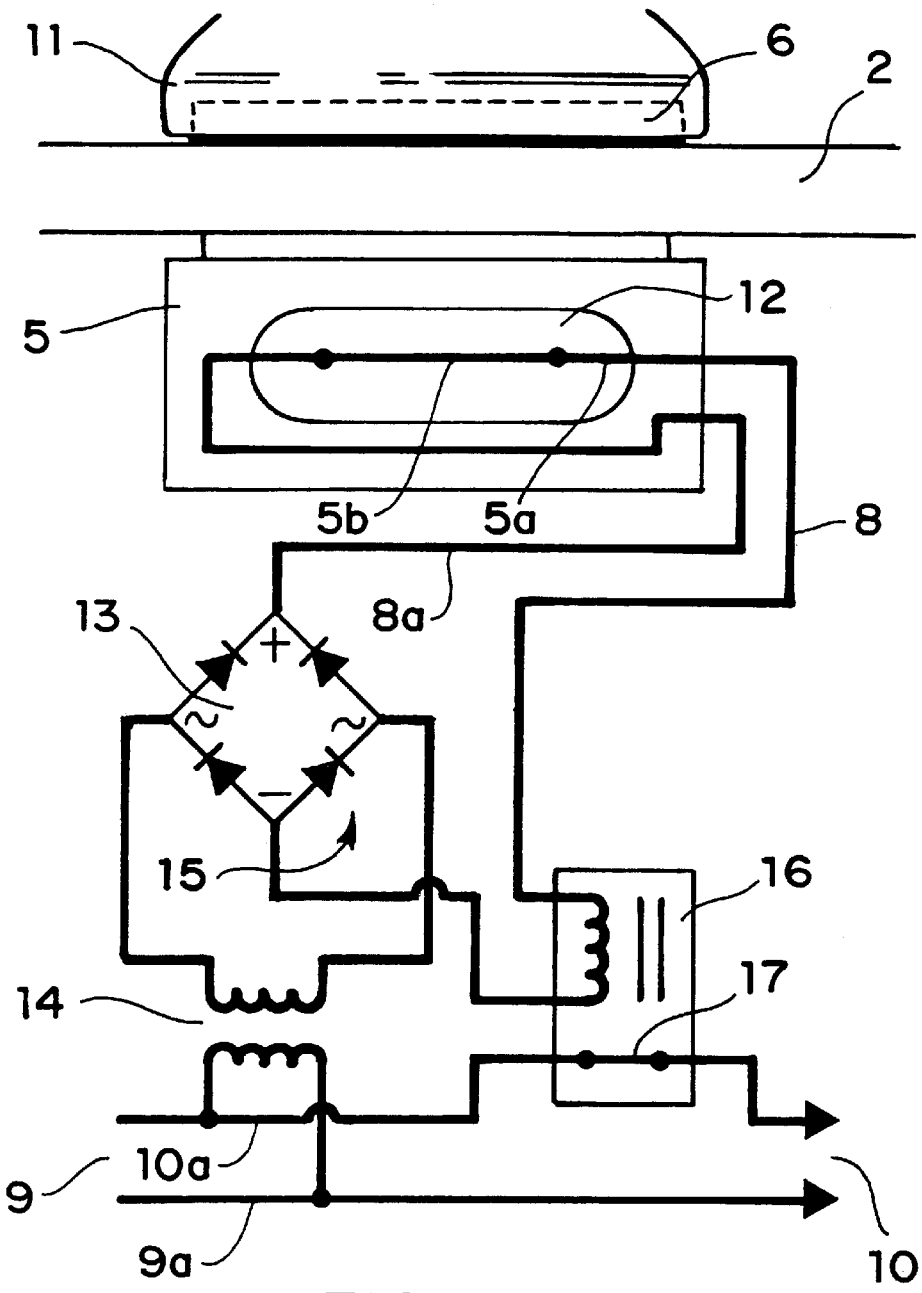
FIG. 2 shows the circuitry used in the system of FIG. 1.

The wiring 8 from the reed switch 5 leads into the control device 7 and so does the wiring 9 coming from the wall outlet 4. There is a signal in the control device 7 which determines when to send full power to the garbage disposal 3 by way of the line 10. FIG. 2 shows the operation of the control device 7 of FIG. 1. In this Figure and as well in subsequent Figures the same reference characters have been used and explained as in FIG. 1. The reed switch is shown at 5 having the individual reeds 5*a* and 5*b*. The reed switch is in a closed position as shown at 12. This can be seen also by the magnet 6 being located exactly over the reed switch. The magnet 6 has a cover 11 over itself mainly for aesthetic reasons. Included in this circuitry is a rectifier 13 which converts the incoming current from AC to DC. Also it is important to use a transformer 14 to transform the incoming 110 V to a low voltage otherwise the element and power requirements would be rather high and any static currency is almost eliminated as at 15. Finally, there is a relay 16 to operate an electromagnetic 17 which upon a signal from the reed switch 5 will close the switch 17 to thereby operate the disposal unit. Operation: The control box 7 gets its signal from the reed switch 5 to continue with the one line 8 to the relay 16 and the other line 8*a* continues to the rectifier 13. The incoming power 9 by way of line 9*a* and at 110 V continues straight to the garbage disposal unit while part of this line powers the transformer 14. The other line 10*a* participates in the rectifier 13 and is instrumental in powering the relay 16. Line 10*a* exits the control box at 10 again at 110 V to power the garbage disposal unit.

Figure 3:
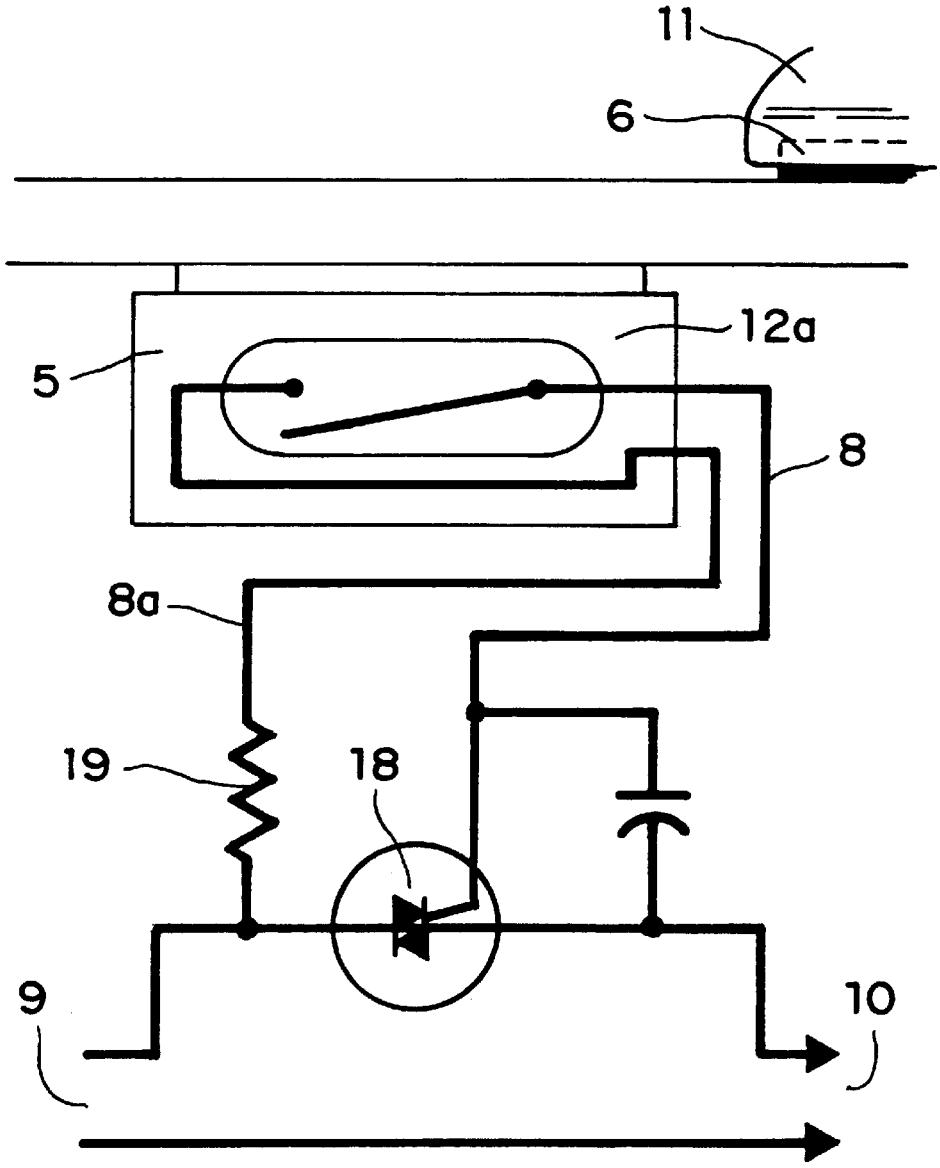
FIG. 3 shows the use of a solid state relay in the circuitry of FIG. 2.

FIG. 3 shows a different use of the electromagnetic switch 16 in FIG. 2 by incorporating a solid state relay 18 into the circuitry. Such solid state relays are well known and, therefore, are not shown in detail. In FIG. 3, reed switch 5 is open because the magnet 6 with its cover 11 has been removed from the vicinity and from above of the reed switch 5. Line 8*a* has incorporated therein a resistor 19.

Figure 4:
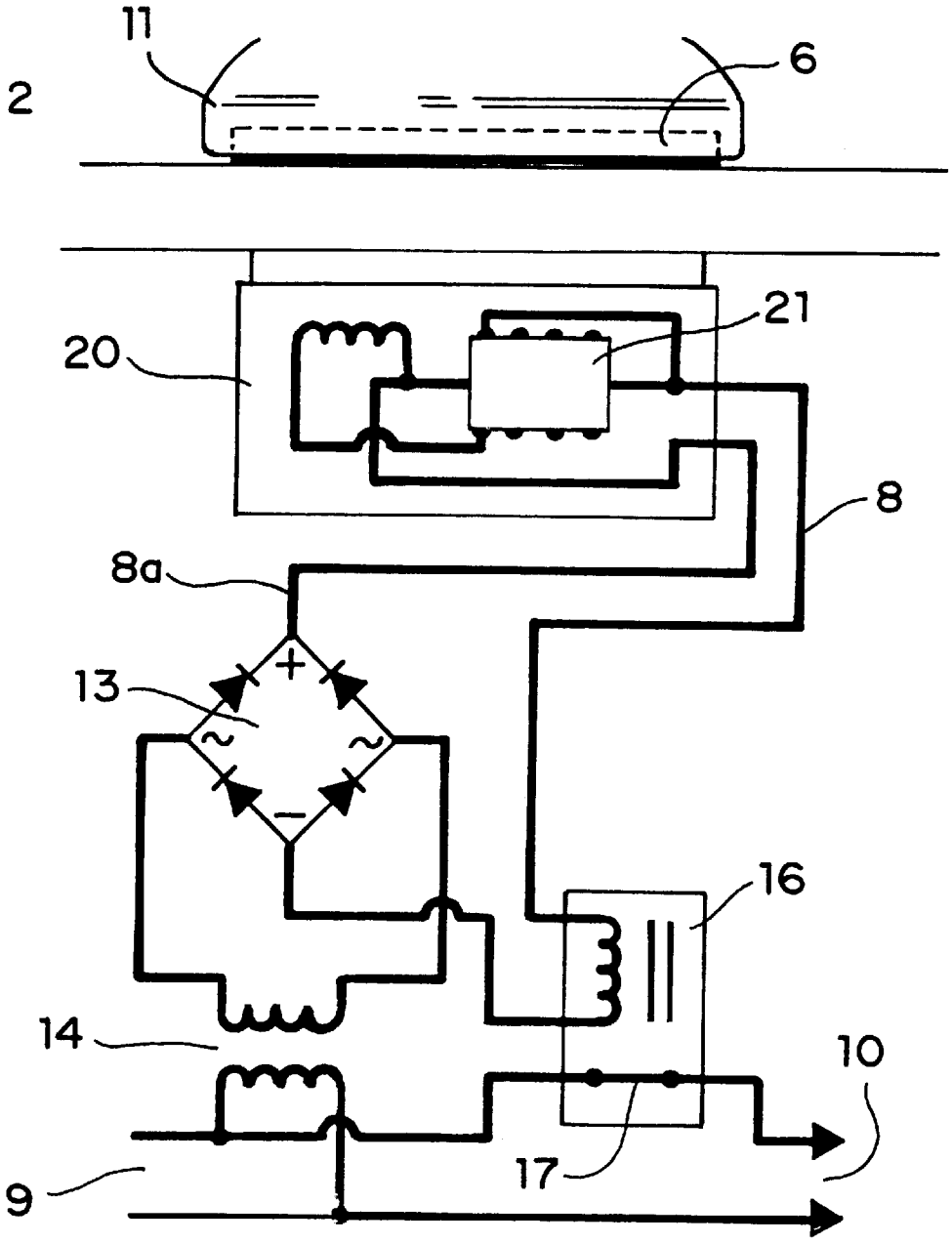
FIG. 4 shows the use of a solid state magnetic switch in the circuitry of FIG. 2.

In FIG. 4, reed switch 5 of the previous Figures has been replaced by a solid state switch 20 which includes the solid state circuitry 21. again the solid state circuitry 21 responds to the magnetic attraction of the magnet 6 instead of a reed switch 5.

It is to be noted that all of the above explained control circuits instead of being used in a control device 7, of FIG. 1, could instead be incorporated in the housing of the motor driving the disposal unit in a factory installed scenario. This could be done in a new installation while all other installations would involve a retro-fitting.

What is claimed is:

1. A reed switch control system for a garbage disposal including a sink installed into a counter top having a garbage disposal unit installed under said sink, an electric motor driving said garbage disposal unit, a reed switch to control said electric motor, said reed switch is mounted under said counter top, an independently movable magnet to activate said reed switch movable over said counter top and said reed switch, said reed switch, when activated sends a signal to a control device, said control device includes means for transforming an incoming higher AC voltage to a lower voltage and means for rectifying said AC voltage to a DC voltage, an electro-magnetic relay for switching said electric motor to an on position upon a signal from said reed switch.

2. The reed switch control system of claim 1, wherein said relay is a solid state device.

3. The reed switch control system of claim 1, wherein said reed switch can be replaced by a solid state switching device which is responsive to said magnet on said counter top.

* * * * *